US009567072B2

(12) United States Patent
Enserink

(10) Patent No.: US 9,567,072 B2
(45) Date of Patent: Feb. 14, 2017

(54) KITE CONTROL BAR WITH INTEGRATED LINE ADJUSTMENT MEANS

(71) Applicant: OCEAN RODEO SPORTS INC., Victoria (CA)

(72) Inventor: Anton Rudolf Enserink, Dordrecht (NL)

(73) Assignee: Ocean Rodeo Sports Inc., Victoria, BC (CA)

( * ) Notice: Subject to any disclaimer, the term of this patent is extended or adjusted under 35 U.S.C. 154(b) by 77 days.

(21) Appl. No.: 14/381,645

(22) PCT Filed: Mar. 18, 2013

(86) PCT No.: PCT/IB2013/052157

§ 371 (c)(1),
(2) Date: Aug. 28, 2014

(87) PCT Pub. No.: WO2013/140329

PCT Pub. Date: Sep. 26, 2013

(65) Prior Publication Data

US 2015/0014487 A1 Jan. 15, 2015

Related U.S. Application Data

(60) Provisional application No. 61/614,462, filed on Mar. 22, 2012.

(51) Int. Cl.

| | |
|---|---|
| ***B64C 31/06*** | (2006.01) |
| ***B63H 9/00*** | (2006.01) |
| ***B63B 35/79*** | (2006.01) |

(52) U.S. Cl.
CPC ..... *B64C 31/06* (2013.01); *B63B 35/7979* (2013.01); *B63H 9/00* (2013.01)

(58) Field of Classification Search
CPC ..... B64C 31/06; B64C 31/028; A63H 27/08; B63B 35/7976
See application file for complete search history.

(56) References Cited

U.S. PATENT DOCUMENTS

| | | | | |
|---|---|---|---|---|
| 2,388,478 | A * | 11/1945 | Garber | A63H 27/002 244/153 R |
| 6,273,369 | B1 | 8/2001 | Nishimura et al. | |
| 6,336,607 | B1 * | 1/2002 | Perrier | A63H 27/002 242/388.6 |
| 6,877,697 | B2 | 4/2005 | Bellacera | |
| 8,573,540 | B2 | 11/2013 | Bonieux | |
| 2012/0018584 | A1 | 1/2012 | Lawson | |

FOREIGN PATENT DOCUMENTS

| | | | |
|---|---|---|---|
| DE | 20315464 | U1 | 12/2003 |

* cited by examiner

*Primary Examiner* — Christopher P Ellis
*Assistant Examiner* — Jessica Wong
(74) *Attorney, Agent, or Firm* — Davis & Bujold, PLLC; Michael J. Bujold

(57) ABSTRACT

A hollow kite control bar is provided with means for sliding access to the bar for one or multiple lines or groups of lines. Each line has one end towards the kite and the other towards the bar. The length of each line between the kite and the bar can be adjusted by pulling into and releasing from the bar, which length or lengths can be locked at multiple positions in one or more locking means fixed to the bar. The excess line length pulled in is automatically held inside the bar.

7 Claims, 2 Drawing Sheets

KITE CONTROL BAR WITH INTEGRATED LINE ADJUSTMENT MEANS

TECHNICAL FIELD

The present invention relates to rider control systems for propulsive wings and sport traction kites. More particularly the present invention relates to a kite control bar adapted with a control line sheeting system that functions to allow the rider to quickly, reliably and comfortably trim the tension on the kite control lines in order to adjust the kite power to the wind conditions, kite size and/or riding style, and construction thereof.

BACKGROUND ART

Using a kite for wind-driven propulsion of water, land, ice and or snow-craft is highly effective and simple compared to other means of wind-driven propulsion like sails and turbines. A kite can be constructed in such a way that all or most of the pulling force enters the craft in one point, without resulting momentum that can tip the craft over and without the requirements for rigid elements like masts, poles and shafts connected to the craft. Kites are flying remote from the craft, in air layers with stronger winds, and can fly in figures across the sky in order to generate apparent wind, thus increasing the power. Thus, kites are very efficient as means to derive power from the wind.

Traction kites need to be manipulated constantly in order to control the flying trajectory of the kite to generate the required traction, to handle wind-gusts, and to keep the kite from falling to the ground.

For smaller crafts, like buggies, surfboards and dinghies, the kite can be controlled by hand. One common way of manipulating a kite is by means of a 3 point control system, where one centrally placed line bears the main load of the kite, and two control lines are manipulated to sheet in and out the flexible left and right tips of the kite. The centrally place line attaches to a structural part of the craft, or, in case of surf style kiting where the rider stands on a wheeled or sliding board, to a point on a harness worn by the rider, and whereby the two control lines attach to the ends of a control bar. The control bar often features a central hole through which the central load bearing line is slideably lead. In analogy to sheeting a sail on a sail craft, by sliding the bar away from the fixed point on the central load bearing line, the tips of the kite are sheeted out, allowing the wind to pass the kites canopy, while by sliding the bar towards the fixed point on the central load bearing line, the kite catches more wind and will thus power up. By puffing one side of the bar, the kite will sheet in on the side pulled, and out on the other. This will cause the kite to turn around the sheeted in side.

The sliding motion or 'stroke' of the bar is limited on one side by the assembly that attaches to the rider's harness, and on the other by either the length of the rider's arms or parts of the control system.

In order to control the kite comfortably and safely, kite control systems all allow for some degree of correction for stronger winds or larger kites, or to adapt the kite to a different riding style. By correcting the length of the load bearing line relative to the control lines, the bar stroke can be matched with the circumstances and style of the rider.

Most kites feature correction or 'trim' systems that shorten or lengthen the central load bearing line, either by using cleat or friction based systems. Because in this case only one line needs to be shortened or lengthened, such systems are simple to build. Yet, because it is the load bearing line the rider is trimming, operating requires lots of force. Obviously, such systems have to be built very strong and heavy, while all parts of such trim assemblies are subject to wear. Also, trimming the central load bearing line can only take place on either side of the bar stroke, close to the rider's body or away from the rider at arm's length, neither a good ergonomic location for precisely adjusting of trim controls.

Another major disadvantage of central load bearing line trimming is that rider error, or failure of a cleat or strap system, can result in the central load bearing line assuming its maximum length, which enlarges the projected area of the kite canopy towards the wind. A kite can thus become heavily over-powered and instantly cause extremely dangerous situations for both rider and bystanders.

Yet another disadvantage is that trimming the central load bearing line is mostly done by short pulling motions on that line in a direction away from the kite. By tugging on the central load bearing line, which attaches to the front side of the kite, the kite can suddenly over fly and fall from the zenith. This can result in dangerous situations, varying from line tangles to sudden tightening of lines and uncontrolled looping of the kites.

A smaller disadvantage, but worth mentioning, is the behavior of bar stoppers on center line trimmed kites. Various types of bar stoppers are installed on different kite control systems, mostly to limit the up stroke of the bar. Control systems that trim the center line from the harness attachment point, referred to as 'below the bar trimming', will have the stopper moving along with the trimming motion of the line. This implies that the rider needs to re adjust the stopper after trimming the center line.

An alternative to central load hearing line trimming is control line trimming, like described in DE20315464U1 (2003) and US2012018584A1 (2011). Both these publications show methods for guiding the control lines in to the bar, where they are joined, while a single trim line is attached at the joint. The trim line is in turn led out of the bar through an opening and can be pulled or released to set the length of the control lines, and locked by means of a clamping device. By doing so, the left and right control line can be trimmed simultaneously. A disadvantage of such systems is that the trim line can dangle freely from the bar, which is annoying and can be dangerous as the trim line can wrap around the riders hand or tangle with other lines in the control system. Even if means for retaining the line are present as for instance hook and loop patches or a magnet, these will have to be handled by the user, which takes away attention and focus from maneuvering the kite. Another disadvantage of these particular systems is that the pulling direction is perpendicular to the bar or respectively away from the end of the bar. Both pulling movements are very unpractical, and it will be difficult to keep the kite flying a straight line during trimming. Yet another disadvantage is that clamping a line by friction induces wear to both line and clamping device, while slippage can occur at such clamps. Furthermore, it is difficult to see how much control line is pulled in; one would need to judge this by estimating the length of line dangling from the bar. A big disadvantage of friction based clamping devised like cleats is, that they lock tighter and tighter over time, which leads to considerable operating forces. Applying such forces to a kite control bar can induce sudden control error, which is obviously dangerous.

In the early days of kite surfing, some reel bars were manufactured, like for instance U.S. Pat. No. 6,877,697.

These mechanisms could be used to trim the lines relative to each other, but their size, complexity and number of moving parts would make them unsuitable for kite surfing. Sand ingress in to a bar is impossible to avoid, and sea water, sea-weed, and all sorts of debris found on most kite beaches as well as snow and ice for snow-kiters will render a too complex mechanism useless in minutes, unless a most simple design is used.

As larger kites need more leverage to be steered, kite bars are used in different sizes. It is not uncommon for a rider to own two or three different length bars. In order to limit the number of bars a riders needs for his quiver of kites, some kite bars offer adjustable length, either by a telescopic part towards the end of the bar or by offering multiple fixing points for knotting the kite control lines. Undoing the usually very tight knots to change the effective length of a bar is hard to do, especially when a kiter has cold and wet fingers. An obvious disadvantage of a telescopic construction is their sensitivity to sand and salt, while another disadvantage is the indirect feel of the bar when the bar ends can rattle a bit.

Kite bars are most commonly made from tubular alloy or glass fiber elements with separate bar-ends, joint with adhesive and rivets. A usual way of building the central section with the central hole is to use an alloy centerpiece with tubular segments attached to either side. These rather complex multi-part assemblies induce a risk of breakage of the bar.

These current bar constructions do not allow for much functional geometry on the inside of the tubular element. Routing lines through the bar and passed the central hole, and adding clamping means is difficult, and the function will be limited as sand, water and or ice will accumulate inside the bar.

It needs to be mentioned that use of propulsive wings and traction kites involves a number of risks, some of which already discussed above. Pilot error as well as material error can cause serious injury and even death as the forces produced by kites can quickly amount to dangerous levels. Designing kites and kites control systems needs tai involve very serious failure analysis of every part.

Solution to Problem

Technical Solution

The present invention overcomes the limitations and disadvantages present in the art by providing a design and construction method for a kite control system having a control bar that allows for quickly and securely trimming the control lines length simultaneously and for locking the set length in discrete positions. Further, the present invention incorporates a new way to manufacture a kite control bar, and a quick and secure method for adjusting the effective bar length as measured between the points where the control lines access the bar.

While kites and kite control systems can have more than three lines near the fixed point on the vessel or rider, the invention is demonstrated primarily in a common 3 point control system comprising a central load bearing line and left and right control lines.

A hollow kite control bar is therefore adapted with a means for sliding access of the control lines to each end, which sliding means can also function to redirect the lines towards the center of the bar. The bar may further contain more sliding means to redirect lines to the required section of the bar.

Such sliding means can be made as rigid smooth surfaces or as sheaves. The control lines can thus be guided towards a locking section of the design, where the line are shortened and locked in multiple discrete steps by their ends, so that all lines are neatly stored inside the bar and no excess length of line can dangle from the bar.

The lines may be grouped inside the bar, and joined to a single length of trim line, which is in turn shortened or lengthened to set the required amount of trim for the control lines, or the lines can be joined at their end and be jointly locked.

As the locking section will be located on the bar between the points of access of the control line, the direction of one of the control lines can be reversed by looping it around a redirection sliding means in order to allow pulling and releasing of both control lines simultaneously.

In a preferred embodiment of the invention, the discrete steps are presented by an array of receiving pockets, while the control lines are joined at their end, and provided with a stopper. Such a stopper can be a knot in the lines, or a separate part fixed to the lines end. To the stopper, a short piece of webbing is attached to enable a user to hold and manipulate the stopper. The advantage of webbing is that it will not be in the way of the user's hands when operating the kite bar. The stopper can be placed in one of the receiving pockets by pulling a length of the control lines in to the bar against the line tension caused by the kite pulling, and releasing the stopper in to one of the receiving pockets at a location on the bar which corresponds with the required shortening or lengthening of the control lines. The stopper will be firmly pulled in to the receiving pocket by the tension on the control lines. In order to assist the user of the stopper, an elastic cord is attached to the stopper, which is looped around a sliding means, and attached to one of the control lines, thus forming a trim loop. This way, the stopper is held against the bar, and will slide into the first receiving pocket it meets when the stopper is let go outside of a receiving pocket. In order to increase the pulling of the elastic cord towards the bar and therewith the array of receiving pockets, the bar is slightly curved.

Another elastic cord is attached to one of the control lines on one side, and at a fixed point on the bar at the other, in such a way that it ensures a minimum tension on the trim loop in a direction that pulls the stopper in to a receiving pocket.

In another embodiment of the invention, the trim line is wound on a compact reel. The reel is provided with a ratchet gear, and is at one side mounted to the bar structure in such a way it can both rotate about its axis and pivot along a plane parallel to the lines wound on the reel. The teeth of ratchet gear provide discrete locking positions of the control line adjustment system. To the reel is further attached a knob, which is concentric with the reel and gear, and located on the opposite side of the mounting point at the bar. The pivoting motion is limited at the side the lines are pulled from, and a fixed pawl is located right where the gear is pressed against the bar structure by the pulling force of the lines. The gear has teeth slanted to one side, so that it can slide over the pawl when turned in the winding direction, and locks at the pawl when attempted to turn in the unwinding direction. By pivoting the reel assembly away from the pawl, the reel assembly can unwind some line. During use, the control lines can be trimmed in discrete steps: a portion of line is wound by each tick of the gear when a tooth passes the pawl and unwound one tick by simply nudging the reel assembly away from the pawl. In order to unwind more line, the user can simply push out the knob for some time and let the tension of the line turn the reel, until enough line is unwound. The reel assembly will automatically lock as soon as the knob is released.

Thus, the present invention involves providing a kite control system wherein easy and safe adjustment of the control line length is accomplished. Compared to present art involving central load hearing line length adjustment, the invention provides an easier to operate system that in case of failure will depower the kite instead of dangerously powering it up. The invention allows for a more compact, lightweight design of the trimming system. Compared to present art involving control line length adjustment at the bar, the multiple discrete adjustment positions obtained by the invention provide secure and safe locking of the line length with little wear and without slippage. The partly U-shaped cross section of the bar allows for draining of sand and debris from the construction, which is important to ensure functioning in demanding conditions. Further, both embodiments presented are operated without excess line hanging out of the bar, thus avoiding annoying dangling of the line. The presented embodiment with the array of receiving pockets provides a clear view of the amount of line trimmed just by looking in which receiving pocket the stopper is placed.

BRIEF DESCRIPTION OF DRAWINGS

Description of Drawings

Figure 1:
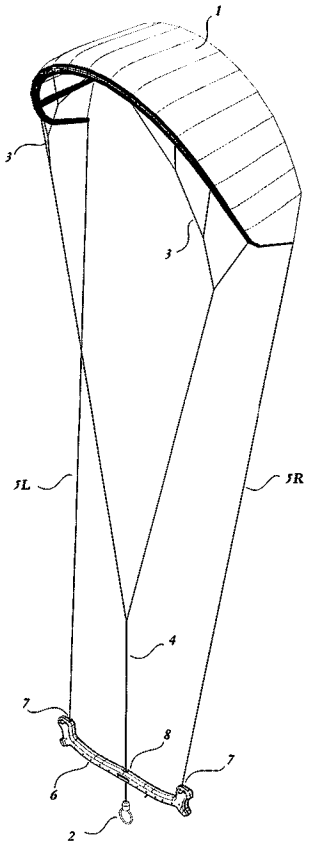

FIG. 1 depicts a kite with its control system, featuring a bar providing simultaneous length adjustable control lines according to the present invention.

Figure 2A:
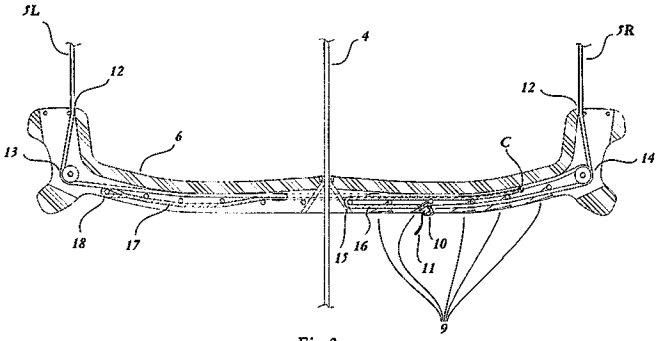
Figure 2B:
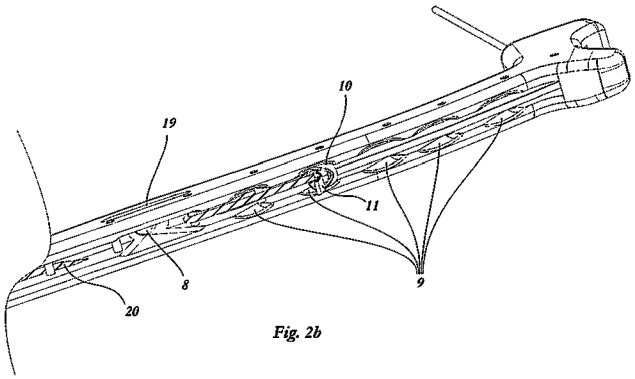

FIGS. 2*a* and 2*b* depict a kite control bar provided with a control line adjustment system comprising an array of receiving pockets.

Figure 3A:
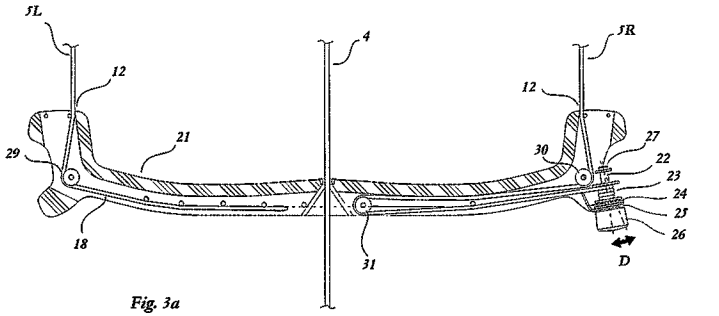
Figure 3B:
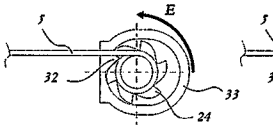
Figure 3C:
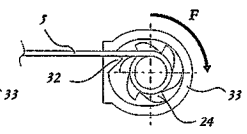

FIGS. 3*a*, 3*b* and 3*c* depict a kite control bar provided with a control line adjustment system comprising a compact reel.

Figure 4:
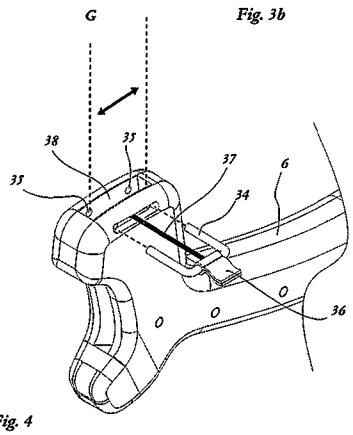

FIG. 4 depicts a view at a control bar end with shift able sliding means.

BEST MODE FOR CARRYING OUT THE INVENTION

Best Mode

Referring to FIG. 1*a*, a kite 1, with anchoring means 2, is provided with a typical 3-point control system which has multiple lines 3 attached to the forward edge which converge in to a central load hearing line 4 which attaches to the anchoring means 2, where the length of the lines 3 and central load bearing 4 together define length A, and two control lines 5L and 5R, attached to both ends of the trailing edge, with length B, each having access to a control bar according to the present invention 6 through means for sliding access 7. The bar is further provided with a centrally placed hole 8 through which the central load bearing line can slide.

In general use, the flying kite is controlled by movement of the bar 6 relative to the anchoring means 2. Sliding the bar 6 over the central load bearing line 4 in a direction away from the anchoring means 2 results in the kite assuming a position with less projected area towards the wind, while pulling the bar towards the anchoring means gradually increases the projected area towards the wind, giving the kite more lift and therewith more tension on the lines 4 and 5. Holding the bar skewed shortens one of the control lines 5 relative to the other, which results in the kite turning in the air. The total sliding movement of bar 6 relative to the anchoring means 2 over the central load bearing line 4 needed to fully control flying of the kite defines the bar stroke.

The start and end position of the bar stroke relative to the central load bearing line 4 can vary with the wind conditions, as well as kite size and riding style. To adjust the start and end position of the bar stroke in order to provide safe and comfortable operation, and to allow for specific riding styles, the bar according to the present invention 6 allows for adjusting of the lengths of the control lines 5 simultaneously.

FIGS. 2*a* and 2*b* show a kite control bar 6 according to a preferred embodiment of the invention providing an array of locking means 9 each of which can accept a stopper 10. The stopper is provided with a tab 11 for convenient adjusting of the control lines length. FIG. 2*a* is a longitudinal cross section view, FIG. 2*b* a view at the arrangement of the stopper 10 and the locking means 9.

In FIG. 2*a* the means for sliding access 12 by which the control lines 5 enter the bar, and the redirecting sliding means 13, 14 and 15 are shown.

Further, the arrangement of the control lines 5 and elastic cords 16 and 17 inside the bar is shown. For a better understanding of this embodiment of the present invention, the routing of the control lines 5 can be followed. Coming from the kite 1, each control line 5L and 5R access the bar 6 at the means for sliding access 12. The control lines 5 are then redirected towards the center of the bar by the redirecting sliding means 13 and 14, which in this embodiment are sheaves in order to reduce friction and therewith the force needed to operate the bar, as well as wear of the lines and components in the bar.

This figure depicts an arrangement of the bar according to the invention in a typical right handed setup with the array of locking means located to the right, however the bar is constructed in such a way that upon user preference it can be used reversed, with the locking means on the left side.

Control line 5R runs from the right redirecting sliding means towards the stopper 10. From the left redirecting sliding means 13, control line 5L runs all the way across bar 6 to the right redirecting sliding means 14, where it meets control line 5R. By running across bar 6, control line 5L needs to by-pass the central hole 8 in bar 6. This is done by routing the control line 5L through a smooth by-pass channel 19.

From the right redirecting sliding means 14 control line 5L goes on to stopper 10, inside of which it is joined with control line 5R. This joined may be a knot that ties the control lines 5L and 5R together, but these line might just as well made from one single length of line, locked inside the stopper with a half hitch knot. This has two benefits: Even if the knot slips, the control lines still run from the bar towards the kite, thus eliminating the risk of a line slipping out of the bar. The other benefit is that the half hitch knot is very compact, allowing for a very compact design of stopper 10. The stopper can be inserted in any of the locking means 9, and will be pulled in to the locking means by the tension on the control lines. Thus, a secure and easy to operate control line length adjustment system is achieved with multiple discrete locking positions.

A significant aspect of the present invention is that no lines can dangle from the bar when the kite is flying, as this is very annoying for the rider and even dangerous as loose line can wrap around limbs and pieces of equipment. The arrangement of locking means 9 and stopper 10 has no excess line so there is nothing dangling from the bar.

From the stopper towards the center of the bar runs an elastic retaining cord 16. Close to the center the elastic retaining cord 16 is redirected by redirecting means 15 towards point C on control line 5L, where retaining cord 16 is joined to control 5L thus forming a trim loop. The retaining cord assists in keeping the stopper 10 against the bar and in to a locking means when the rider lets go of the stopper 10 when it is outside of a locking means. By pulling stopper 10 towards the center of bar 6, the trim loop turns clock-wise and the control lines 5L and 5R are pulled into the bar and therewith shortened. As such, locking stopper 10 in a locking means close to the center of the bar 6 powers the kite up while locking stopper 10 in a locking means towards the right hand end of bar 6 de-powers the kite.

A second elastic cord 17 is attached to control 5L proximate to point C, and runs from there passed the center of bar 6 through a by-pass channel 20 to fixing point 18. This elastic ensures there is tension in the section between point C and stopper 10 in control line 5L, which keeps stopper 10 locked securely in the locking means it has been set in, even if there is no tension on the control lines 5.

This embodiment of the bar according to the present invention thus provides a quick, reliable and comfortable method of adjusting the length of the control lines of a kite with a 3-point control system.

A second embodiment of the present invention is depicted in FIGS. 3*a*, 3*b* and 3*c*.

This embodiment comprises a bar 21, adapted with a reel assembly, comprising a shaft 22, a reel 23, a ratchet gear 24, a sliding pulley 25 and a knob 26, all solidly fixed together in a way that does not allow spinning of the parts relative to each other. The reel assembly is in this embodiment placed towards the end of bar 21, with the knob 26 protruding from the bar in a way the user can easily access it when maneuvering the kite. The reel assembly is attached to the bar on the end of the shaft 22, for instance by a screw 27 in a slightly over-sized hole 28 in a rigid part of the bar, such that the shaft assembly can both rotate about its axis, as well as pivot about the over-sized hole 28. Arrow D indicates direction and amount of pivoting.

Similar the first embodiment, the control lines 5L and 5R have access to the bar 21 by means for sliding access 12, and are redirected towards the center by redirecting sliding means 29 and 30. Control line 5L is guided passed the center of bar 21 towards the reel assembly, and Control line 5R is redirected by a redirecting sliding means 31 located close to the center of bar 21 towards the reel assembly. Both control lines 5L and 5R can be wound on the reel jointly, or they can be joined to a reel line in order to be able to wind more line on a compact reel. Thus, the length of the control lines 5 can be adjusted by turning the reel assembly, meeting the important aspect of the present invention that no line length is left to dangle from the bar.

In order to lock the line length securely while keeping operation of the reel easy, the ratchet gear cooperates with a fixed pawl. Usage conditions of kite control bars do not allow for sensitive mechanisms, hence the sheer simplicity of this embodiment. The FIGS. 3*a* and 3*b* depict how the ratchet gear 24 is moved to and away of a pawl 32. As pawl 32 is located towards the pulling direction of the joint control lines 5 according to arrow D', the gear will automatically lock on to pawl 32 as long as there is tension on the control lines 5.

Arrow F depicts the winding direction. As the ratchet gears teeth are slanted to one side, they can push the reel assembly to pivot in the direction of arrow D", so to unlock the ratchet gear from the pawl. The pivoting motion is limited to a direction longitudinal to the bar by bracket 33.

Unwinding the control lines 5 from the reel 23 is only possible when the reel assembly is pivoted away from the pawl along arrow D", easily done by the rider by pushing the knob 26 away from the center of bar 21. The reel assembly is then free to turn in the direction of arrow E.

FIG. 4 shows a close up of a bar end adapted with means for sliding access 12 which can be shifted to two positions G and H. Shifting of the means for sliding access of a control line 5 increases or decreases the effective length of the bar and therewith the amount of control when one side of the bar is pulled. To shift the means for sliding access of a control line 5, a U shaped bracket 34 with two parallel segments can be pulled from two sliding channels 35 by a short webbing tab 36, and against an elastic cord 37, such to open a slot 38 and allow the control line 5 to traverse from one extreme position in slot 38 to another, from G to H to decrease the effective length of bar 6, or from H to G to increase the effective length of bar 6. By releasing the webbing tab, the U shaped bracket 34 can slide back in to its starting positions assisted by elastic cord 37, thus embracing control line 5 in another position.

The invention claimed is:

1. A kite control bar comprising:

a control bar having a line receiving channel extending axially through with a fixed pawl towards one end;

a reel pivotally mounted towards one end of the control bar and extending into the line receiving channel, the reel having a shaft with a knob on the shaft to enable manual rotation of the reel, the reel having a ratchet gear, the reel being pivotally movable from an engaged positioned in which the ratchet gear of the reel is engaged with the pawl on the control bar thereby preventing rotation of the reel and a disengaged position in which the ratchet gear of the reel is disengaged from the pawl on the control bar thereby allowing rotation of the reel; and at least one control line passing along the line receiving channel of the control bar and engaged with the reel, tension on the at least one control line biasing the reel into the engaged position, the reel being moved to the disengaged position to wind in a winding direction to shorten a length of the at least one control line or unwind in an unwinding direction to increase the length of the at least one control line.

2. The kite control bar of claim 1, wherein the control bar is U shaped in cross-section, thereby allowing drainage of sand and debris.

3. The kite control bar of claim 1, wherein a length of line from the at least one control line is stored within the line receiving channel of the control bar through the use of a redirecting sheave centrally located within the line receiving channel, and the at least one control line is looped around the redirecting sheave prior to being wound onto the reel.

4. The kite control bar of claim 3, wherein there is a left side control line and a right side control line, both of the left side control line and the right side control line being wound onto the reel, with one of the left side control line or the right side control line being looped around the redirecting sheave prior to being wound onto the reel, such that rotation of the reel in a first rotational direction concurrently winds both the left side control line and the right side control line onto the reel and rotation of the reel in a second rotational direction concurrently unwinds both the left side control line and the right side control line from the reel.

5. The kite control bar according to claim 1, wherein the ratchet gear has teeth slanted to slide over the pawl when turned in the winding direction, and the teeth engaging the pawl and resisting rotation in the unwinding direction.

6. The kite control bar according to claim 1, wherein the reel is moved from the engaged position to the disengaged position by pushing the knob away from a center of the control bar.

7. A kite control bar comprising:

a control bar having a line receiving channel extending axially through with a fixed pawl towards one end;

only a single reel pivotally mounted towards one end of the control bar and extending into the line receiving channel, the single reel having a shaft with a knob on the shaft to enable manual rotation of the single reel, the single reel having a ratchet gear, the single reel being pivotally movable from an engaged position in which the ratchet gear of the single reel is engaged with the pawl on the control bar thereby preventing rotation of the single reel and a disengaged position in which the ratchet gear of the single reel is disengaged from the pawl on the control bar thereby allowing rotation of the single reel; and at least one control line passing along the line receiving channel of the control bar and engaged with the single reel, tension on the at least one control line biasing the single reel into the engaged position, the single reel being moved to the disengaged position to wind in a winding direction to shorten a length of the at least one control line or unwind in an unwinding direction to increase the length of the at least one control line.

* * * * *